US005924197A

United States Patent [19]

Murakami et al.

[11] Patent Number: 5,924,197

[45] Date of Patent: Jul. 20, 1999

[54] METHOD FOR MANUFACTURING AN INK JET PRINTING HEAD

[75] Inventors: Shuichi Murakami, Kawasaki; Hirokazu Komuro, Yokohama; Takashi Fujikawa, Isehara; Ken Tsuchii, Sagamihara; Norio Ohkuma; Hideto Yokoi, both of Yokohama, all of Japan

[73] Assignee: Canon Kabushiki Kaisha, Tokyo, Japan

[21] Appl. No.: 08/768,587

[22] Filed: Dec. 18, 1996

[51] Int. Cl.[6] ..... B41J 2/01

[52] U.S. Cl. ..... 29/890.1; 228/115; 347/20; 347/65

[58] Field of Search ..... 29/890.1, 611; 228/115, 116, 190, 205, 208; 347/20, 63, 65

[56] References Cited

U.S. PATENT DOCUMENTS

| | | | |
|---|---|---|---|
| 4,625,373 | 12/1986 | Duffield et al. | 29/890.1 |
| 4,860,033 | 8/1989 | Shiozaki et al. | 346/140 R |
| 4,881,318 | 11/1989 | Komuro et al. | 29/827 |
| 5,322,811 | 6/1994 | Komuro et al. | 437/51 |
| 5,479,197 | 12/1995 | Fujikawa et al. | 347/63 |
| 5,485,185 | 1/1996 | Sueoka et al. | 347/64 |
| 5,491,505 | 2/1996 | Suzuki et al. | 347/203 |
| 5,580,468 | 12/1996 | Fujikawa et al. | 216/27 |

OTHER PUBLICATIONS

"The Use of Ion Beam Cleaning to Obtain High Quality Cold Welds with Minimal Deformation" Sater, Bernard L. and Moore, Thomas. J., NASA Technical Memorandum, NASA TM–78933, Oct. 17–19, 1978.

*Primary Examiner*—P. W. Echols
*Attorney, Agent, or Firm*—Fitzpatrick, Cella, Harper & Scinto

[57] ABSTRACT

A method for manufacturing an ink jet printing head comprises a step of joining together a base board having ink discharge pressure generating elements, which also forms the bottom of a plurality of ink paths, and a ceiling plate that forms the ceiling portion of the plurality of ink paths in order to provide an ink jet printing head. In this method, either one of the joining portions between the base board and ceiling plate is Si and the other one of them is metal, and after each of the joining portions is irradiated by an energy particle, the base board and the ceiling plate are made in contact and cold joined by the application of cold activation. With the method of manufacture thus provided, it is possible to make the intensity of joint between the ceiling plate and base board firmer so as to eliminate any gaps between them, hence preventing the creation of cross talk phenomenon, and the degradation of quality of printed images as well.

12 Claims, 5 Drawing Sheets

METHOD FOR MANUFACTURING AN INK JET PRINTING HEAD

BACKGROUND OF THE INVENTION

1. Field of the Invention

The present invention relaters to a method for manufacturing an ink jet printing head. More particularly, the invention relates to a method for joining together a base board having elements for generating ink jet discharge pressure and the members on the base board that constitute an ink jet head. The invention further relates to an ink jet printing head manufactured by such method of manufacture.

2. Related Background Art

Usually, an ink jet printing head is provided with elements for generating ink jet discharge pressure that generates energy to be used for discharging ink. The heads are roughly divided into two kinds depending on the ink discharge pressure generating elements. One is the head provided with electrothermal transducing elements as the ink discharge pressure generating elements. The other is the head whose ink discharge pressure generating elements are formed by electro-mechanical transducing elements.

In conjunction with FIG. 8, the description will be made of the general structure of an ink jet printing head, which uses electrothermal transducing elements as ink discharge pressure generating elements.

In FIG. 8, a reference numeral 100 designates a heater board (a base board) formed by Si having plural arrays of electrothermal transducing elements (discharge heaters) arranged on it, and electric wiring (electrodes) made of Al or the like to supply electric power to each of the heaters, both of them being produced by the application of thin film formation techniques.

A reference numeral 200 designates a circuit board arranged for the heater board 100, which is provided with the wiring (to be connected to the heater board by means of wire bonding, for example), and arranged corresponding to the electric wiring of the heater board 100, as well as with pads 201 positioned at the edge portion of the wiring to receive electric signals from the apparatus main body. A reference 1300 designates a grooved ceiling plate, which is provided with partition walls to form a plurality of divided ink paths, each conductively connected to the discharge ports, respectively, and also, with a common liquid chamber and others that serve as portions to hold ink to be supplied to each of the ink paths. This ceiling plate is formed integrally with the ink reception inlet 1500 that receives ink supplied from an ink tank and guides it into the common liquid chamber, together with an orifice plate having discharge ports arranged for it.

A reference numeral 300 designates a supporter made of metal, for example, that supports the reverse side of the wiring board 200 by use of the flat surface of the supporter, and serves as the bottom plate of the ink jet printing head.

A reference numeral 500 designates a pressure spring to fix the heater board and the grooved ceiling plate under pressure. The sectional surface of the spring is M-letter shaped in the direction in which the ink paths are arranged. At the same time, the spring is provided with an apron 501 in the vicinity of the discharge ports. Then, the foot portions arranged for the pressure spring are each allowed to engage with the reverse side of the supporter 300 through the hole 3121 of the supporter 300, thus exerting pressure, while holding together the heater board and the grooved ceiling plate. At this joining portion, a part of the flow paths, preferably the area thereof in the vicinity of the discharge ports, is linearly pressed intensively, while the common liquid chamber is lightly pressed by the central portion of the M-letter shape of the spring.

Further, a sealing agent is applied to the circumference of the joining portion of the heater board and the grooved ceiling plate in order to prevent ink leakage from the ink paths.

However, in accordance with the prior art whereby to fix the heater board and the grooved ceiling plate under pressure by the application of the intensive biasing force exerted by the pressure spring, it is impossible to completely eliminate the gap between the grooved ceiling plate and the heater board at the joining portion thereof if the warping of a grooved ceiling plate is great. Then, if such gap takes place on the jointed portions of the partition walls to the ink paths, the pressure to be used for discharging ink in an ink path is allowed to escape to the adjacent ink paths, thus attenuating the ink discharging output or creating the so-called cross talks that may bring about the varied menisci at ink discharge ports due to such escaping pressure. As a result, the quality of printed images is lowered due to the creation of uneven density and unwanted twisting of ink discharges caused by the variations of discharging speeds and amounts.

Also, for a color ink jet printing head where plural kinds of ink are individually retained in it, such gaps as described above may result in the mixture of colors in some cases.

SUMMARY OF THE INVENTION

The present invention is designed in consideration of the problems described above. It is an object of the invention to provide a highly reliable ink jet printing head capable of preventing cross talks from being generated, thus preventing the quality of printed images from being degraded.

It is another object of the invention to provide a color ink jet printing head that causes no color mixtures between flow paths.

In order to achieve the objects described above, the present invention is structured with a method for manufacturing an ink jet printing head that forms a plurality of ink paths by joining together a base board having a plurality of ink discharge pressure generating elements, which also forms the bottom of a plurality of ink paths, and a ceiling plate that forms the ceiling portion of the plurality of ink paths, wherein either one of the joining portions of the base board and the ceiling plate is formed by Si, while the other one of them is formed by metal, and after each of the joining portions between them is irradiated by an energy particle, the base board and ceiling plate are made in contact and cold joined by the application of cold activation.

In accordance with the present invention, since the base board and ceiling plate are cold joined reliably by the application of cold activation, it is possible to prevent the creation of any gaps in the location where the base board and ceiling plate are joined, thus providing a highly reliable ink jet printing head, which is capable of preventing any cross talks, and then, the quality of printed images from being degraded. Also, there is no need for the provision of any pressure spring, thus contributing to providing ink jet printing heads at lower costs in a higher production yield. Further, it is possible to provide an ink jet printing head that does not allow any color mixture to occur between flow paths when used as a color ink jet printing head that retains plural kinds of ink individually in the head.

DETAILED DESCRIPTION OF THE PREFERRED EMBODIMENTS

Figure 1:
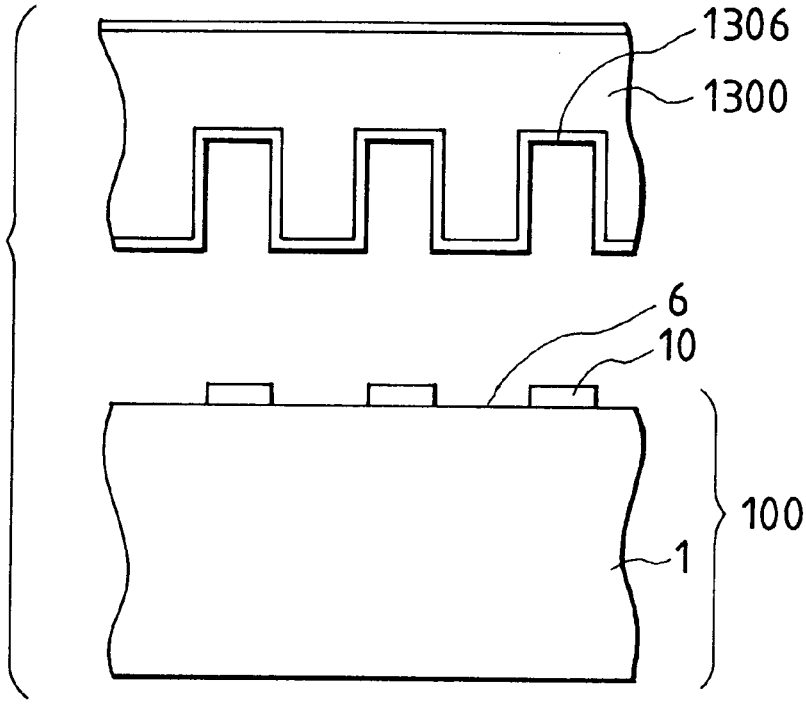
FIG. 1 is a cross-sectional view which shows a ceiling plate and a heater board in accordance with a first embodiment of the present invention.

Hereinafter, the present invention will be described in detail.

The description will be made of the principle of cold joining by means of the surface activation to be used for joining a heater board (base board) and a ceiling plate in accordance with the present invention.

At first, by the irradiation of energy particles, such as the irradiation of a high-speed electron beam, the impurities and functional layer that adhere to the surface of Si and metal are physically removed in order to enable the clean metal and Si surfaces to be exposed. In this way, the exposed surfaces of the cleaned metal and Si are activated. Then, the exposed surfaces themselves are caused to contact each other to join them together at such exposed surfaces, thus obtaining a firmly joined state of the metal and Si.

Here, as a metal to be used for this joining method, Al, Cu, or Ag may be named, but the metal is not necessarily limited to any one of them so long as the chosen metal can provide a good joining state with Si by the application of cold activation.

The joining method of the present invention described above is executable at an ordinary temperature. Therefore, unlike the conventional joining method where metals are joined directly, no heating is required. With the cold joining method, no stress is generated nor is there any texture change at the joined interface. This is also a method for joining metal surfaces directly without using any bonding agent. Therefore, using this method for joining the base board and ceiling plate of an ink jet head makes it possible to avoid damaging the base board by the application of heat, and to provide an ink jet head, which is not easily affected by cross talks. Also, there is no possibility that any overflow of a bonding agent to the flow paths that may often occur if the base board and ceiling plate are joined by the application of a bonding agent. No variation is caused with respect to the height of flow paths due to the varied thickness of applied bonding agent. As a result, it is possible to manufacture highly reliable ink jet heads in a high production yield.

For the present invention, a member formed from Si may be either a base board or a ceiling plate. Also, the metallic part in the joining portion is provided by forming the heater board or the ceiling plate itself from metal, but it may be possible to form each joining portion of members by the formation of a thin metallic film. If the metallic part of each joining portion is formed by a thin metallic film, the selectivity of members is enhanced. When the members are formed by resin or the like in particular, it becomes easier to produce ink jet heads and provide them at lower costs.

In accordance with the present invention, known structures can be used for making heater boards and ceiling plates. In this case, the extrusions that serve as side walls of the ink paths may be arranged either on the base board side or on the ceiling plate side. Here, the base board and ceiling plate of the present invention can be produced using known methods.

Embodiments

Hereinafter, the description will be made of the embodiments in accordance with the present invention.

First Embodiment

FIG. 1 is a cross-sectional view which shows a ceiling plate and a heater board in accordance with a first embodiment.

Figure 2:
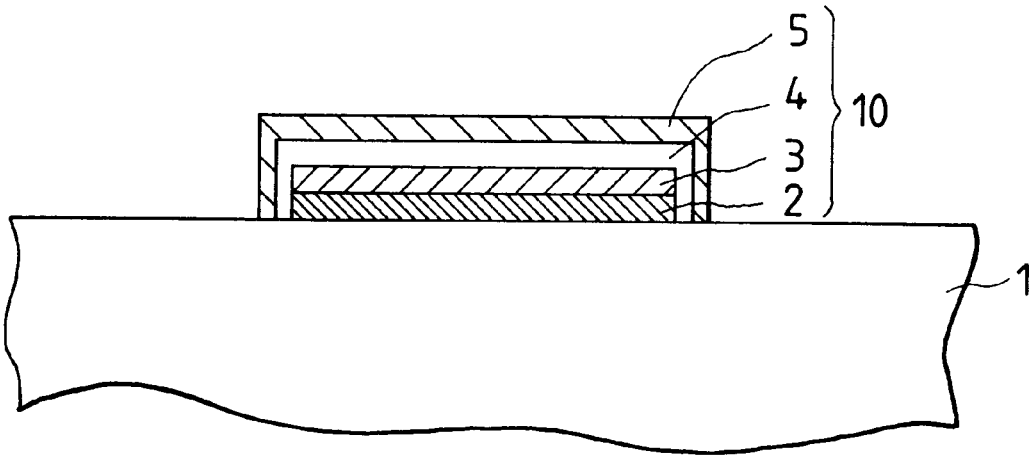
FIG. 2 is a detailed cross-sectional view which shows the heater board represented in FIG. 1.

FIG. 2 is a detailed cross-sectional view showing the heater board represented in FIG. 1.

In FIG. 1, a heater board 100 is produced by sputtering $HfB_2$ on a silicon substrate in a thickness of 1,000 Å as a heat generating resistive layer, and an electrode layer is arranged on it also by sputtering Al in a thickness of 5,000 Å.

Then, since the Si surface should be exposed at the joining portion with respect to the ceiling plate 1300, the layer is patterned as shown in FIG. 2 to form the $HfB_2$ heat generating resistive element and Al electrode 3 by use of the photolithography and etching techniques.

On the layer thus patterned, $SiO_2$ is sputtered in a thickness of 1 $\mu$m to form an oxidation-resistant film 4, and further thereon, Ta is sputtered in a thickness of 0.2 $\mu$m to form a cavitation-resistant film 5.

Continuously, then, on the resin ceiling plate formed by means of a formation method or the like, a thin Al film of 1 $\mu$m thick is formed by thin film formation means such as sputtering to provide the joining portion. In this respect, the material to be used for the thin film formation is not necessarily limited to Al. Any material may be used so long as useful for making such joining portion by the application of surface activation.

Now, in order to join the heater board and the ceiling plate, each of them is installed on a joining equipment. The joining equipment comprises two vacuum chambers, a preliminary chamber and a pressure contact chamber. The degree of vacuum is 10.5 Pa. Then, in the pressure contact chamber, energy particles are irradiated on the Si surface of the heater board and the joining portion of the ceiling plate, which is formed from the Al thin film by use of the supply source of a high-speed atomic beam of a saddle field type (using inactive Ar gas usually). After the surface is activated by the application of this irradiation, the Si exposed portion 6 of the heater board and the joining portion 1306 of the ceiling plate are joined.

As described above, with the ceiling plate and heater board that have been joined, an ink supplying member is installed through the conventionally known steps of head formation to obtain a liquid jet recording head. For this installation of the ink supplying member, the nozzle unit is also covered by a sealing agent to secure a completely conductive state in accordance with the conventional method, because there exists a gap between the nozzle unit and the heater board. However, in accordance with the present embodiment, the nozzle unit has also been cold joined, which makes it unnecessary to cover the nozzle unit with any sealing agent. The sealing agent is applied only to the supply unit. As a result, there is no possibility that the sealing agent is drawn around to the nozzle unit. Also, for that matter, a sealing agent can be selected from among more suitable ones, which contributes to enhancing the production yield of the heads.

Further, the ceiling plate and heater board are cold joined using surface activation. The joining portion between the ceiling plate and heater board becomes more intensive, while eliminating any gaps between them completely. In this way, it is possible to prevent the creation of cross talk phenomenon, and the degradation of quality of printed images as well.

Second Embodiment

Figure 3:
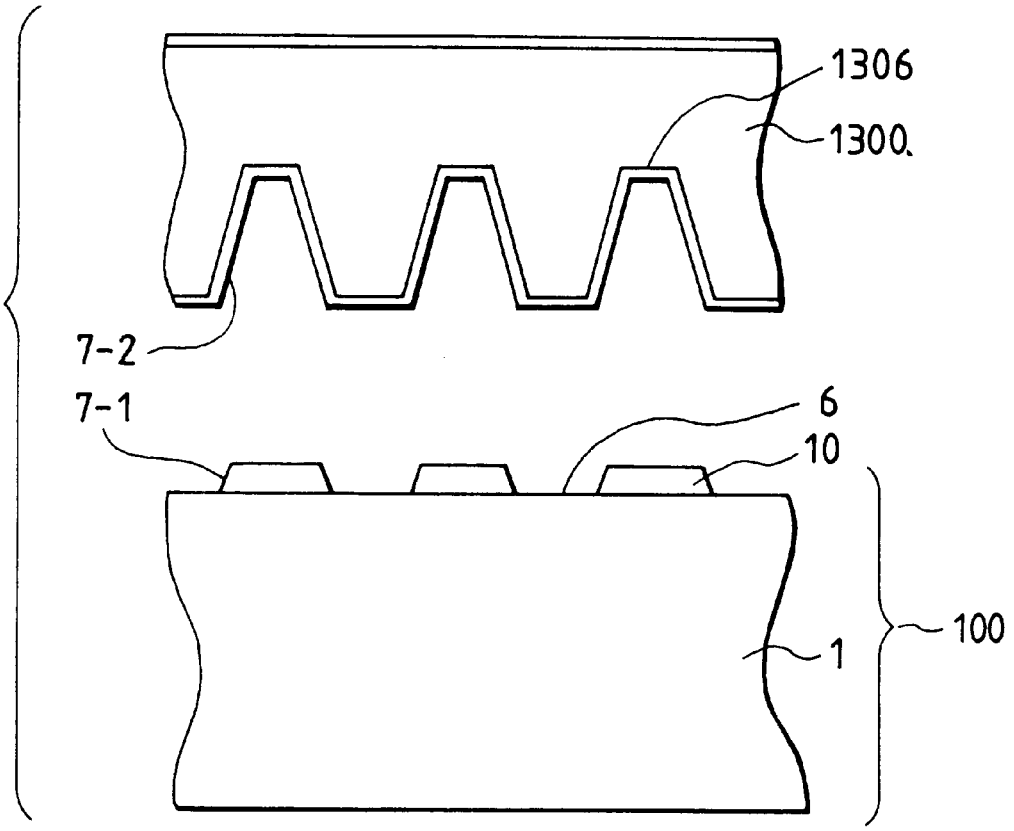
FIG. 3 is a cross-sectional view which shows a ceiling plate and a heater board in accordance with a second embodiment of the present invention.

FIG. 3 is a cross-sectional view which shows a ceiling plate and a heater board in accordance with a second embodiment of the present invention.

Figure 4:
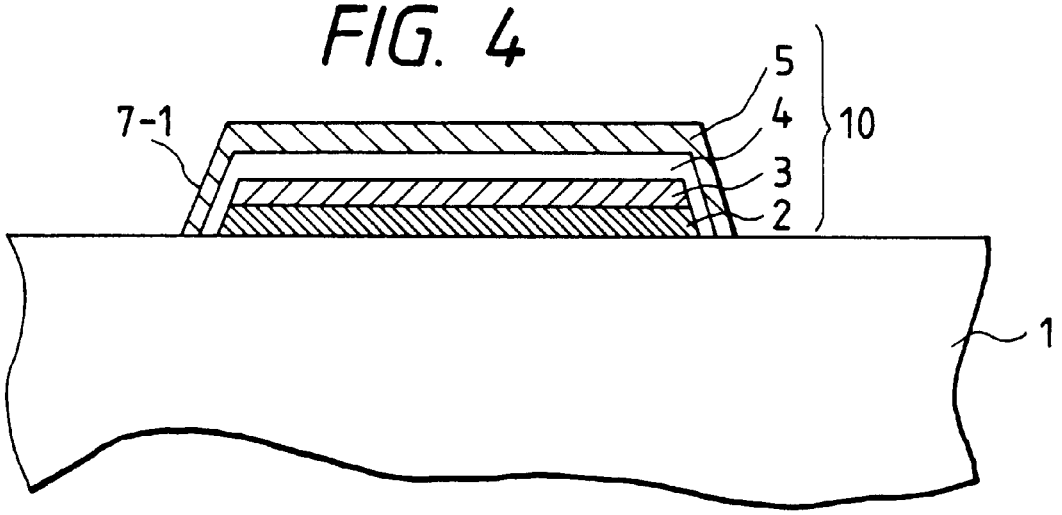
FIG. 4 is a detailed cross-sectional view which shows the heater board represented in FIG. 3.

FIG. 4 is a detailed cross-section which shows that heater board represented in FIG. 3.

In FIG. 3, a layer 10 is formed in four layers on the base board, which includes a protective film and others, and then, by use of photolithography and etching techniques, a taper 7-1 is provided therefor as shown in FIG. 4.

Also, as shown in FIG. 3, each taper 7-2 is provided for the ink paths on the ceiling plate so that it can engage with each of the tapers 7-1 on the base board. In this way, the coupling portions 7-1 are arranged for each of the joining portions on the base board side to engage with the respective tapers 7-2 arranged for each of the joining portions on the ceiling plate side. Thus, it is made possible to shorten the time required for making engagement between the ceiling plate and heater board. At the same time, the contacting area between them is made larger to obtain a firmer joint between the ceiling plate and heater board. Further, it becomes possible to reduce the degree of precision required for setting the irradiation angle of the beam with respect to the heater board. This also contributes to enhancing the productivity of the heads.

Third Embodiment

Figure 7:
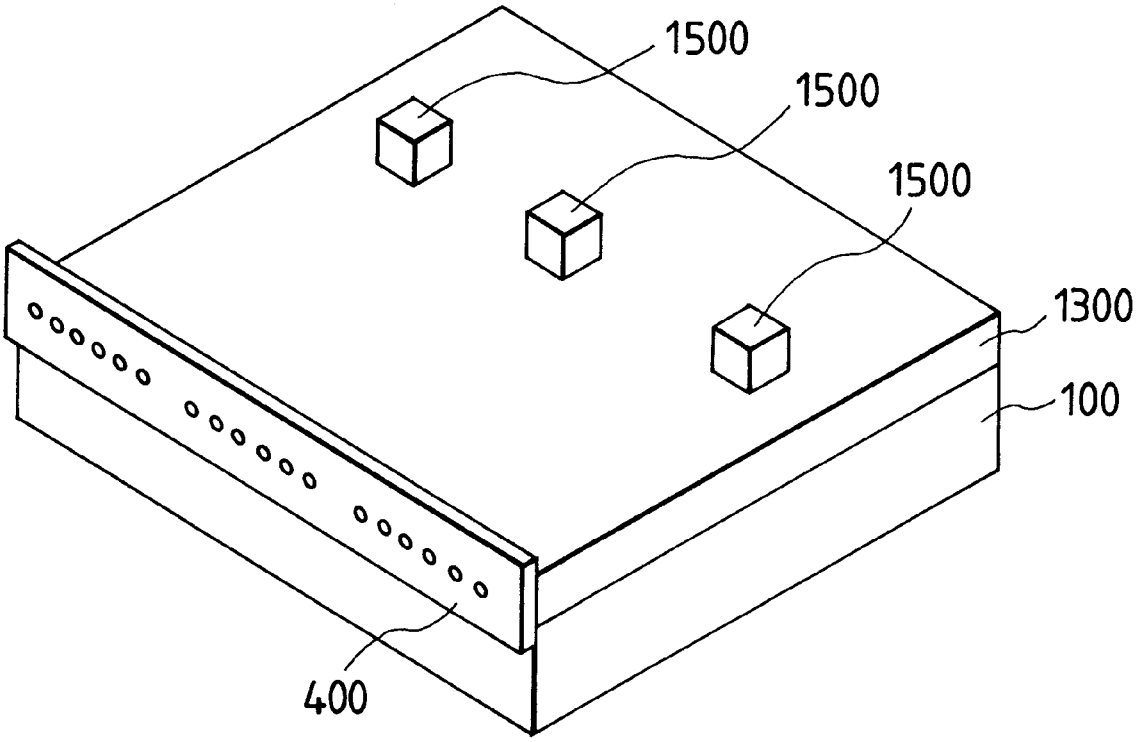
FIG. 7 is a perspective view which shows a color ink jet head.
Figure 8:
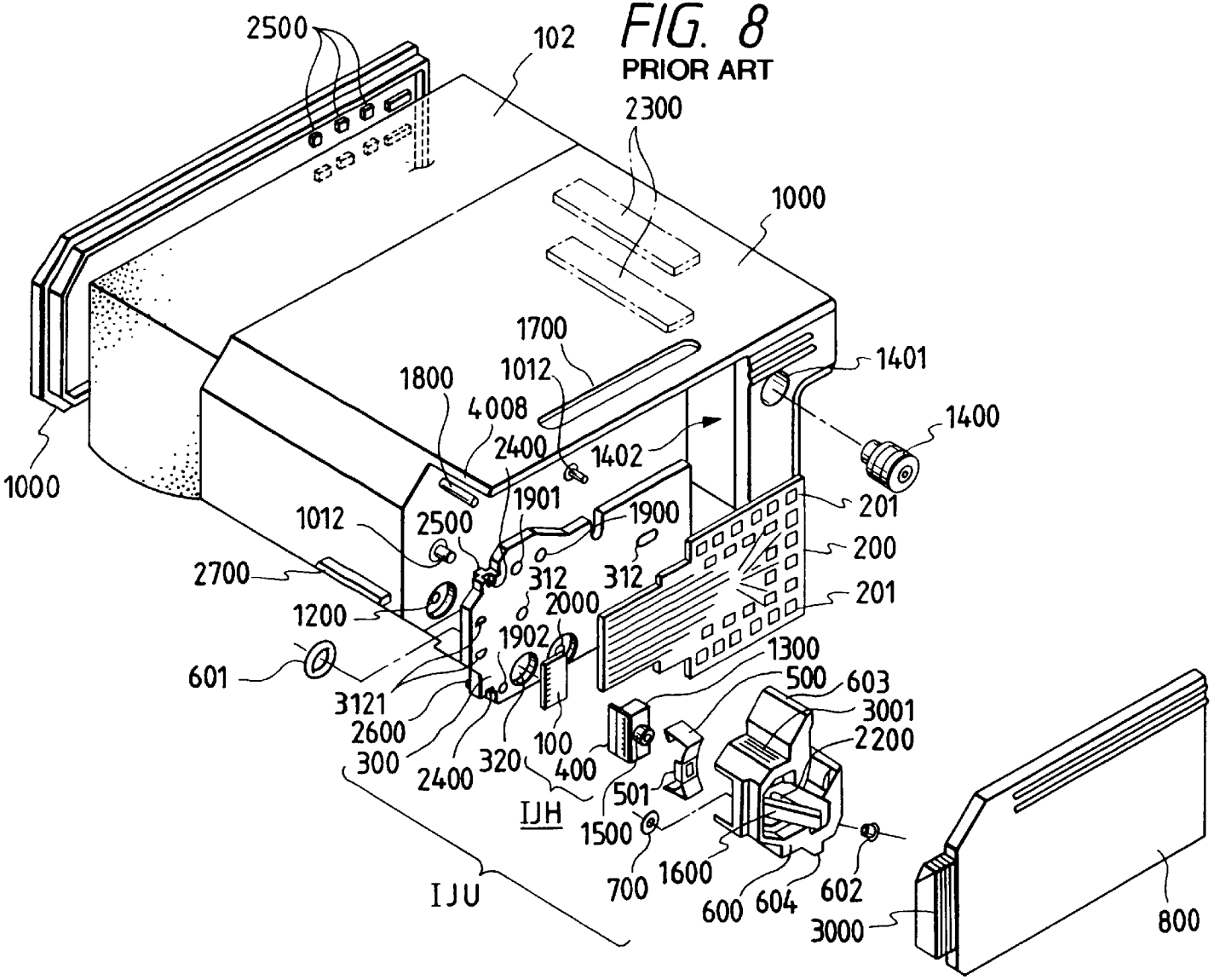
FIG. 8 PRIOR ART
FIG. 8 is a view which shows an ink jet head in accordance with the prior art.

FIG. 7 is a perspective view which shows a color ink jet head in accordance with a third embodiment of the present embodiment.

Figure 5:
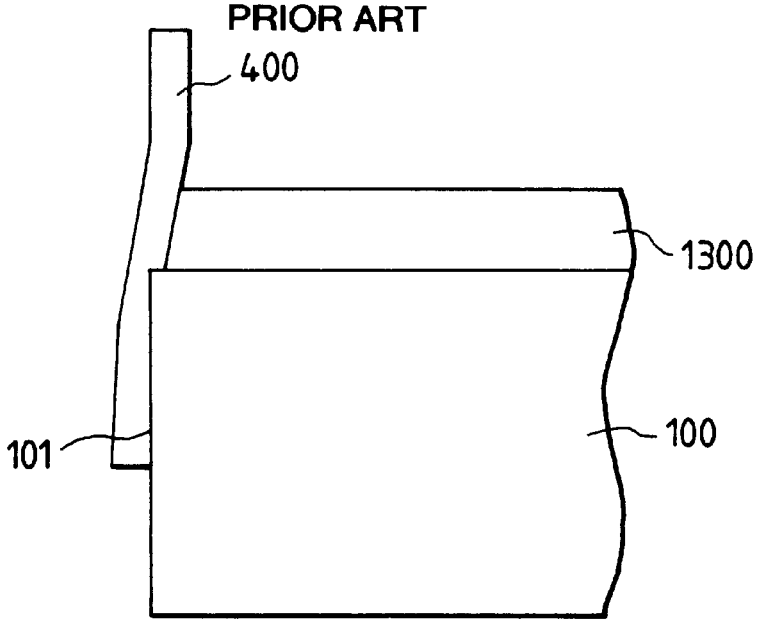
FIG. 5 PRIOR ART
FIG. 5 is a cross-sectional view which shows a color ink jet head in accordance with the prior art.

For a color ink jet head as shown in FIG. 7, when an orifice plate is provided for the ink jet head as shown in FIG. 5, there is a possibility that ink color mixtures take place due to gaps that may be made between the orifice plate and heater board even if the ceiling plate and heater board are intensively joined with a sufficient strength, which does not allow any gaps to be present between them.

Figure 6:
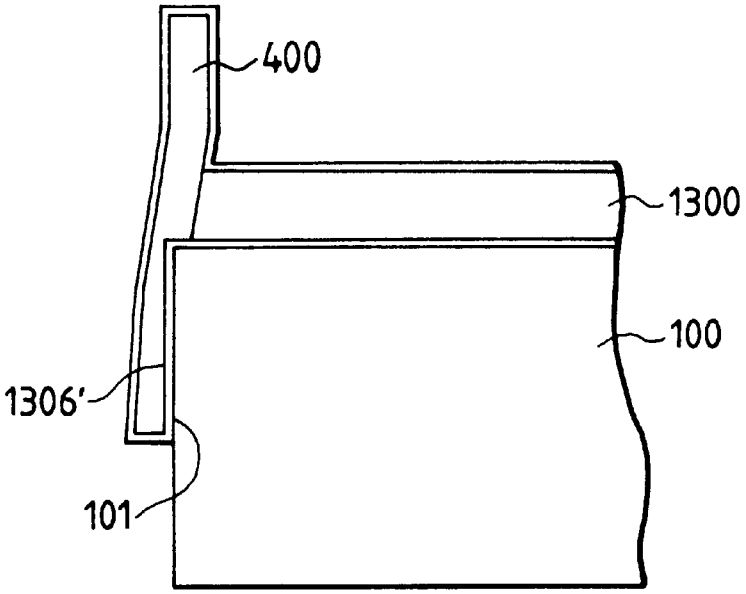
FIG. 6 is a cross-sectional view which shows a ceiling plate and a heater board in accordance with a third embodiment of the present invention.

Therefore, as shown in FIG. 6, joining portions are provided between adjacent nozzles having different colors of ink, while a joining portion 1306' is formed by a thin film of Al or the like between the orifice plate and the base board. Then, these portions and the Si surface of the heater board are cold joined by the application of surface activation in order to enhance both the intensity of the joint and the firmness of sealing.

In accordance with the prior art, it is impossible to obtain a good joining condition on the portion where the orifice plate and the base board are joined, because such portion cannot be pressed by a spring or the like because the provision of such device may result in the requirement of a further distance to a recording sheet or because ink paths may be clogged if a bonding agent is applied. In accordance with the present embodiment, however, it is possible to join the orifice plate and the base board in good condition without any requirement of a distance to a recording sheet other than regularly needed for recording. There is also no possibility that the ink paths are clogged by the application of bonding agent, hence making it possible to provide a highly reliable ink jet head having a good shooting accuracy.

In this way, ink color separation is assuredly provided for a color ink jet head without degrading the quality of printed images due to the color mixtures that may take place in the prior art.

For the embodiments described above, there has been used an ink jet head of the so-called edge shooter type where ink is discharged in the direction almost perpendicular to the electrothermal transducing elements serving as ink discharge pressure generating elements. However, the present invention is not necessarily limited to the use of this type. The invention also demonstrates excellent effects for an ink jet head of the so-called side shooter type where ink is discharged in the direction upward from the electrothermal transducing elements.

Also, the present invention includes the structure where electromechanical transducing elements are used as ink discharge pressure generating elements in place of the electrothermal transducing elements.

What is claimed is:

1. A method for manufacturing an ink jet printing head comprising a step of joining together a base board having ink discharge pressure generating elements and a protective layer for protecting the ink discharge pressure generating elements and forming the bottom of a plurality of ink paths, and a ceiling plate forming the ceiling portion of said plurality of ink paths for the formation of the ink jet printing head, wherein either one of the joining portions between said base board and ceiling plate is Si and the other one of them is metal, and after each of said joining portions is irradiated by an energy particle while the protective layer is provided on the ink discharge pressure generating elements, said base board and said ceiling plate are placed into contact and are cold joined together by a cold activation process.

2. A method for manufacturing an ink jet printing head according to claim 1, wherein said metal is either one of Al, Cu, and Ag.

3. A method for manufacturing an ink jet printing head according to claim 1, wherein said Si is provided for the joining portion on the base board side.

4. A method for manufacturing an ink jet printing head according to claim 1, wherein said Si is provided for the joining portion on the ceiling plate side.

5. A method for manufacturing an ink jet printing head according to claim 1, wherein said base board is provided with a plurality of extrusions which define a plurality of partition walls defining said ink paths, and said base board also has said joining portion.

6. A method for manufacturing an ink jet printing head according to claim 1, wherein said ceiling plate is provided with a plurality of extrusions which define a plurality of partition walls defining said ink paths, and said ceiling plate also has said joining portion.

7. A method for manufacturing an ink jet printing head according to claim 6, wherein coupling portions corresponding to the extrusions formed for said ceiling plate are provided for the joining portion of said base board.

8. A method for manufacturing an ink jet printing head according to claim 1, wherein said ink discharge pressure generating elements are electrothermal transducing elements.

9. A method for manufacturing an ink jet printing head according to claim 8, wherein a functional layer is provided on said base board.

10. A method for manufacturing an ink jet printing head according to claim 9, wherein said base board is formed by Si, and said joining portion on the base board side is formed by removing said functional layer with respect to the ceiling plate joining portion.

11. A method for manufacturing an ink jet printing head according to claim 1, wherein said ceiling plate comprises a resin and also a thin film of said metal is provided on said resin at least at a region corresponding to the base board joining portion.

12. A method for manufacturing an ink jet printing head according to claim 1, wherein said plurality of ink paths retain ink of plural colors individually.

* * * * *